US009997863B2

(12) United States Patent
Matsuura et al.

(10) Patent No.: US 9,997,863 B2
(45) Date of Patent: Jun. 12, 2018

(54) CONNECTOR

(71) Applicant: Sumitomo Wiring Systems, Ltd., Yokkaichi, Mie (JP)

(72) Inventors: Junya Matsuura, Mie (JP); Toshikazu Sakurai, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days. days.

(21) Appl. No.: 15/427,090

(22) Filed: Feb. 8, 2017

(65) Prior Publication Data

US 2017/0256877 A1 Sep. 7, 2017

(30) Foreign Application Priority Data

Mar. 4, 2016 (JP) ..... 2016-041848

(51) Int. Cl.
*H01R 13/44* (2006.01)
*H01R 13/506* (2006.01)

(52) U.S. Cl.
CPC ..... *H01R 13/506* (2013.01)

(58) Field of Classification Search
CPC . H01R 13/4538; H01R 13/631; H01R 11/288
USPC ..... 439/140, 141, 892
See application file for complete search history.

(56) References Cited

U.S. PATENT DOCUMENTS 7,708,572 B2 * 5/2010 Yang ..... G01R 1/0466 439/140
8,272,882 B2 * 9/2012 Sakai ..... G01R 1/0466 439/268

FOREIGN PATENT DOCUMENTS

JP 2015-69836 4/2015

* cited by examiner

*Primary Examiner* — Phuong Chi T Nguyen
(74) *Attorney, Agent, or Firm* — Gerald E. Hespos; Michael J. Porco; Matthew T. Hespos

(57) ABSTRACT

Retainers (37) are exposed on an outer surface of the sub-housing (30) and are displaceable between a locking state for retaining terminal fittings (34) inserted into a sub-housing (30) and a separated state for allowing the terminal fittings (34) to be withdrawn from the sub-housing (30). A frame (10) is formed with a holding portion (20) configured to hold the sub-housing (30) by being locked to the outer surface of the sub-housing (30) and openings (24) expose the retainers (37) with the sub-housing (30) held in the holding portion (20).

5 Claims, 11 Drawing Sheets

CONNECTOR

BACKGROUND

1. Field of the Invention.

The invention relates to a connector.

2. Description of the Related Art.

Japanese Unexamined Patent Publication No. 2015-069836 discloses a waiting side housing to be mounted on a panel of an automotive vehicle. This waiting side housing includes a frame to be locked to the panel, a sub-housing to be assembled with the frame and a retainer. A terminal fitting is inserted into the sub-housing and the inserted terminal fitting is retained by a locking action of the retainer. The sub-housing of the waiting side housing is accommodated in an accommodation space of the frame and the outer surface of the retainer is covered by a peripheral wall of the accommodation space. The terminal fitting may have to be withdrawn from the sub-housing for maintenance. However, withdrawal of the terminal fitting requires the sub-housing to be detached from the frame to expose the retainer. The retainer then must be moved to release the terminal fitting. These many operation steps are problematic.

The invention was completed based on the above situation and aims to improve operability.

SUMMARY

The invention is directed to a connector with a frame and a sub-housing. A holding portion is formed in the frame and is locked to an outer surface of the sub-housing to hold the sub-housing. A terminal fitting is inserted into the sub-housing and a retainer is exposed on the outer surface of the sub-housing. The retainer is displaceable between a locking state for retaining the terminal fitting inserted into the sub-housing and a separated state for allowing the inserted terminal fitting to be withdrawn from the sub-housing. An opening is formed in the frame and is configured to expose the retainer when the sub-housing is held in the holding portion. The terminal fitting can be withdrawn from the sub-housing by displacing the retainer from the separated state to the locking state with the sub-housing mounted in the frame. The sub-housing need not be separated from the frame, thereby reducing the number of operation steps.

The retainer may be coupled to the sub-housing via a hinge. Thus, fewer components are required as compared to the case where the retainer and the sub-housing are separate components.

The retainer may project from the outer surface of the sub-housing in the separated state, and the opening may open backward with respect to an assembling direction of the sub-housing with the holding portion. According to this configuration, the sub-housing can be assembled to the holding portion with the retainer kept in the separated state.

The holding portion may be cantilevered, and may have a reinforcing rib extending along a projecting direction. Thus, the sub-housing can be held reliably in the holding portion by preventing improper deformation of the cantilevered holding portion.

A step may be formed on an outer surface of the frame and may protrude farther out than an outer surface of the retainer. Additionally, the frame may be formed with a guide groove configured to guide a jig from the side of the step toward the retainer for displacing the retainer from the locking state to the separated state. According to this configuration, the jig is moved along the guide groove and is brought closer to the retainer from the side of the step toward the retainer when displacing the retainer to the separated state. The step protrudes farther out than the outer surface of the retainer, and an operation of moving the jig along the guide groove is difficult to perform. Thus, even if the retainer is exposed to the outside in the opening, there is no possibility that the retainer is displaced inadvertently to the separated state.

DETAILED DESCRIPTION

An embodiment of the invention is described with reference to FIGS. 1 to 11. Note that, in the following description, a left side in FIGS. 7 to 11 is defined as the front concerning a front-back direction. Upper and lower sides shown in FIGS. 1 to 9 are defined as upper and lower sides concerning a vertical direction.

Figure 11:
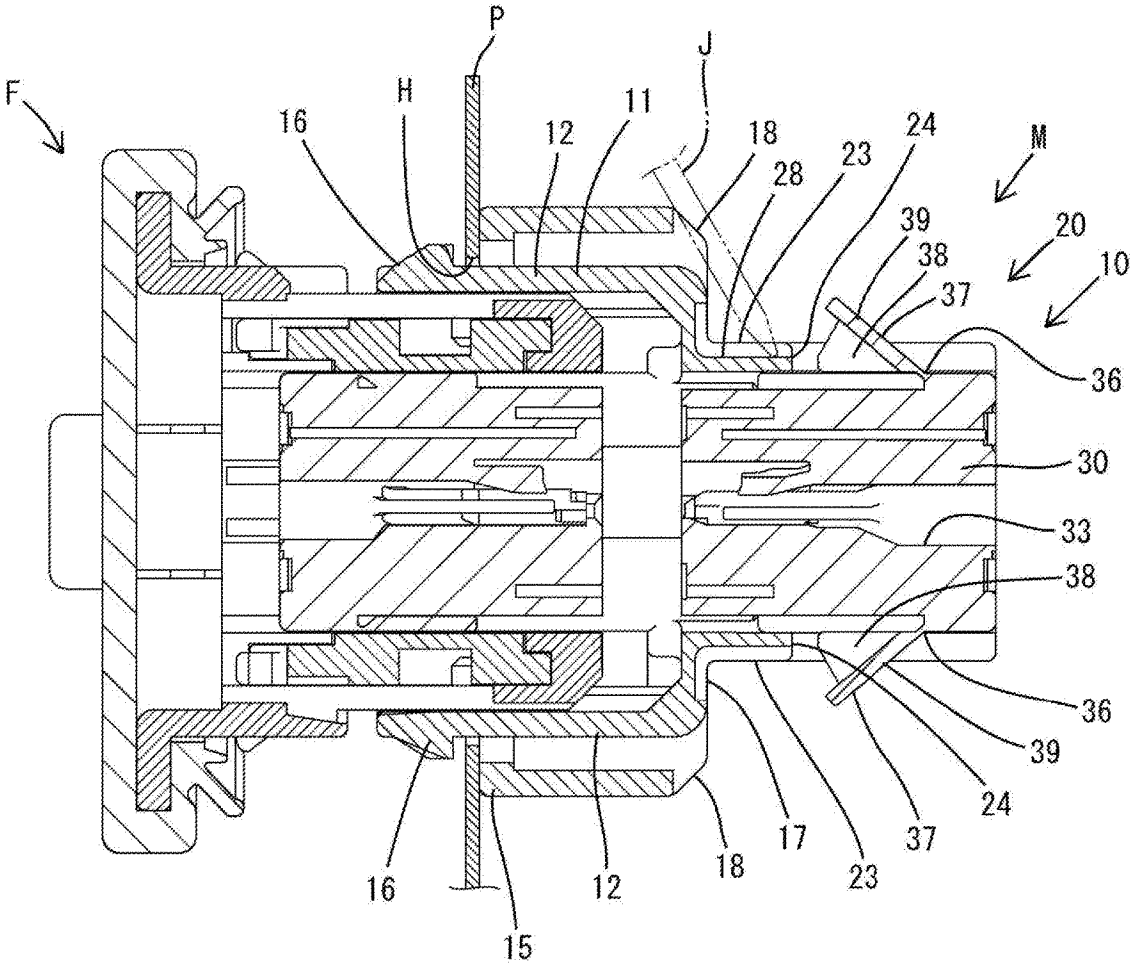
FIG. 11 is a section showing the waiting-side connector mounted on a panel.

A waiting-side connector M of this embodiment is to be mounted on a panel P of a body of an automotive vehicle. A mounting hole H penetrates the panel P from the front surface to the rear surface thereof. As shown in FIG. 11, a fit-in side housing F is connected to the waiting-side connector M mounted on the panel P.

A waiting side housing includes a frame 10 made of synthetic resin and a sub-housing 30 made of synthetic resin is assembled with the frame 10 from behind. The frame 10 is a single component with a receptacle 11, a coupling wall 17 and a holding portion 20. The receptacle 11 has a substantially elliptical shape long in the vertical direction and is open forward. The receptacle 11 includes two bilaterally symmetrical side walls 12. An upper wall 13 having a substantially hollow semi-cylindrical shape couples upper ends of the side walls 12 and a lower wall 14 having a substantially hollow semi-cylindrical shape couples lower ends of the side walls 12.

A flange 15 is formed over the entire circumference on the outer periphery of a front part of the receptacle 11, and the left and right side walls 12 are formed with resilient contact pieces 16. The panel can be sandwiched between the flange 15 and the resilient contact pieces 16 to hold the waiting-side connector M mounted on the panel P. The coupling wall 17 protrudes in substantially at a right angle to the respective walls 12, 13 and 14 from the rear end edge of the receptacle 11. Areas of a rear part of the receptacle 11 where the side walls 12 and the coupling wall 17 are connected define steps 18.

The holding portion 20 is in the form of a vertically long rectangular tube projecting back from the coupling wall 17. The holding portion 20 is composed of an upper holding wall 21, a lower holding wall 22 and left and right side holding walls 23 that couple the upper and lower holding walls 21 and 22. Backward projecting dimensions of the upper and lower holding walls 21, 22 from the coupling wall 17 are larger than those of the side holding walls 23. Due to this dimensional difference, left and right openings 24 are formed in left and right sides of the holding portion 20 to allow communication between the inside and outside of the holding portion 20. The openings 24 are substantially rectangular in a side view and are open backward on the rear end edge of the holding portion 20.

Long narrow left and right reinforcing ribs 25 are formed on each of the lower surface of the upper holding wall 21 and the upper surface of the lower holding wall 22. The reinforcing ribs 25 extend in the front-back direction to make the upper and lower holding walls 21, 22 more rigid and difficult to deform. Further, a front-stop 26 is formed on each of a front part of the lower surface of the upper holding wall 21 and a front part of the upper surface of the lower holding wall 22. A locking lance 27 is formed in a lateral central part of each of the lower surface of the upper holding wall 21 and the upper surface of the lower holding wall 22 and is resiliently deformable in the vertical direction.

Guide grooves 28 are formed in the outer surfaces of the left and right side holding walls 23. Each guide groove 28 is arranged in a vertical central part of the side holding wall 23. The front end of the guide groove 28 is near the step 18 and the rear end thereof faces the front edge of the opening 24. This guide groove 28 enables a jig J to slide in contact therewith in the front-back direction while being positioned in the vertical direction.

Figure 1:
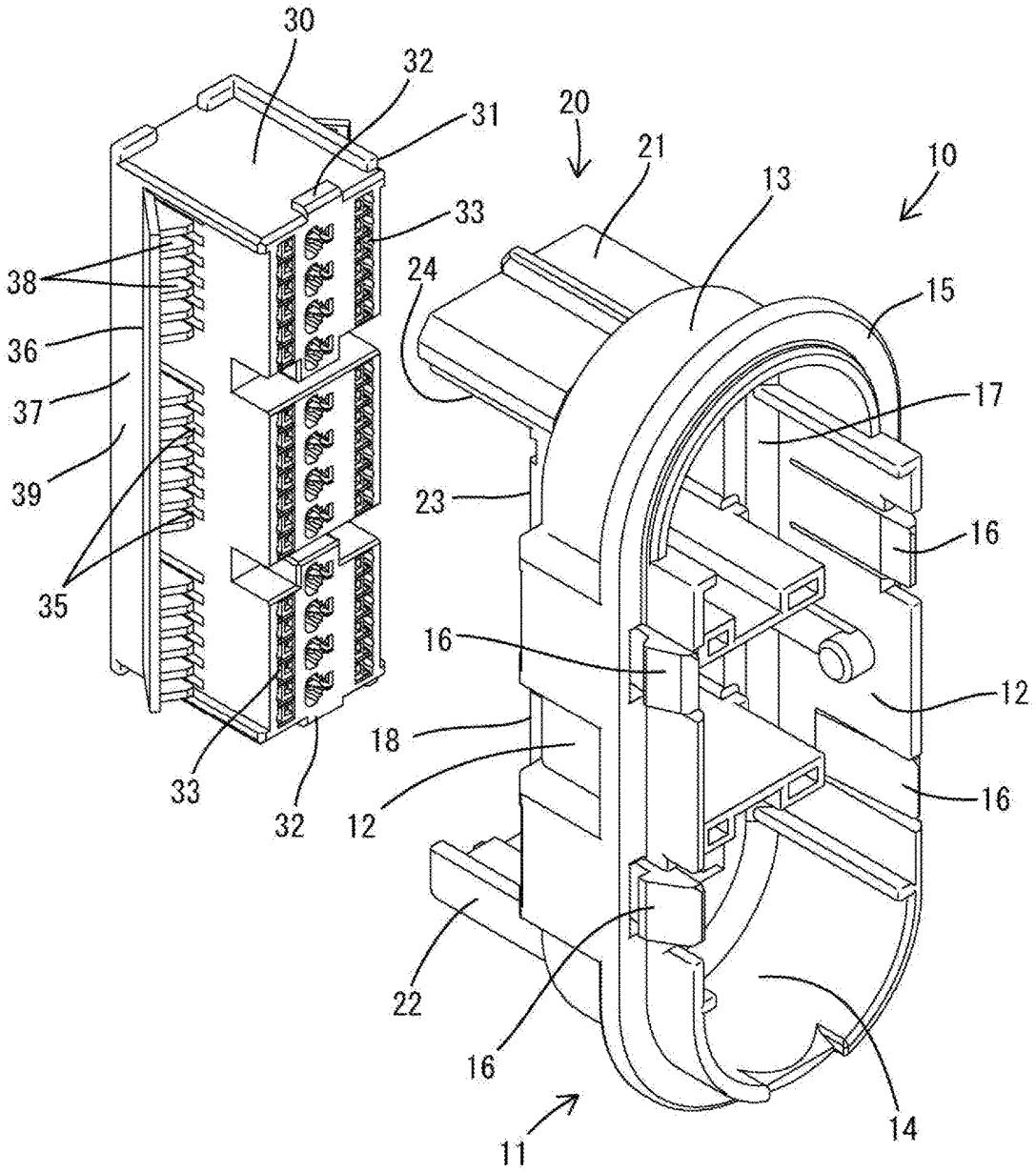
FIG. 1 is an exploded perspective view of a waiting-side connector of one embodiment.
Figure 2:
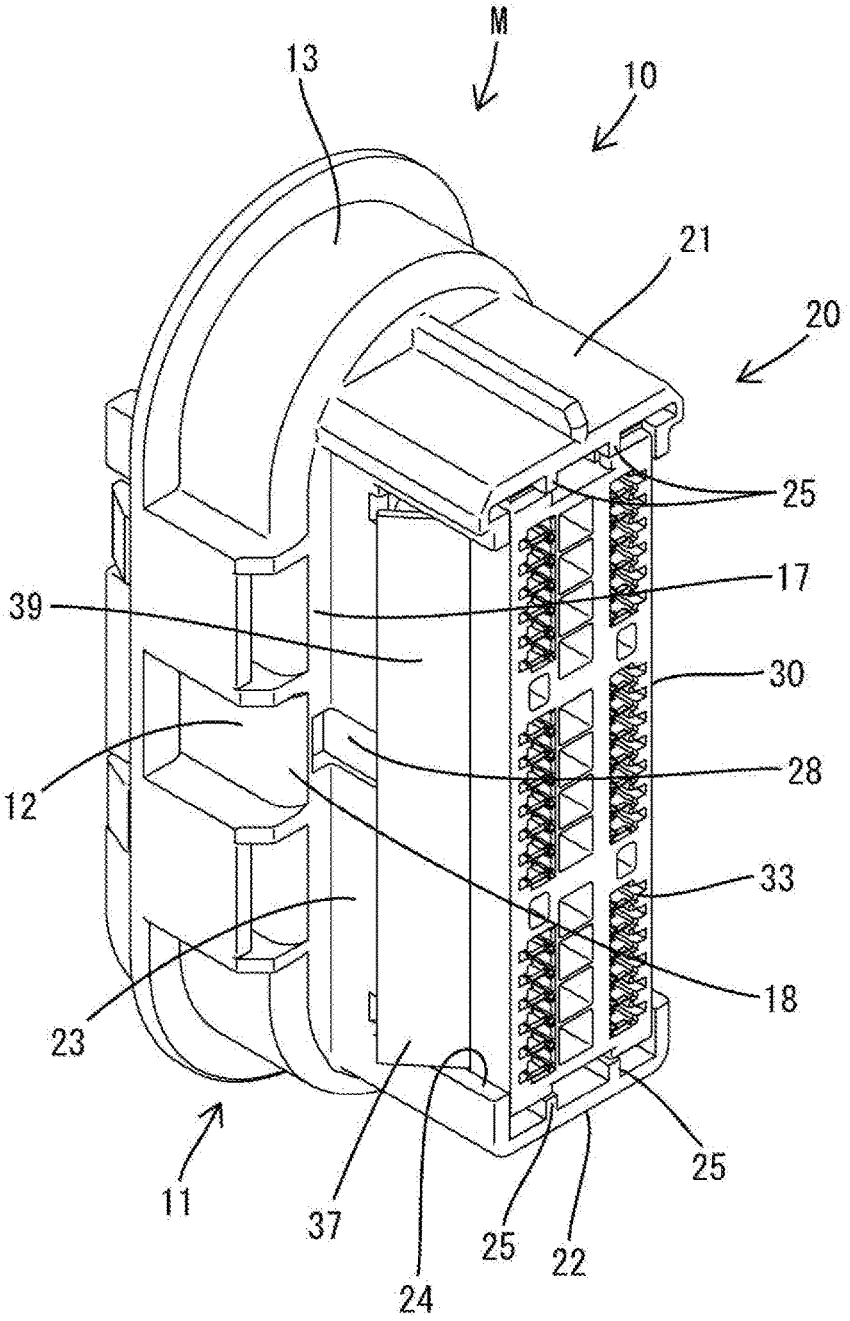
FIG. 2 is a perspective view of the waiting-side connector.
Figure 3:
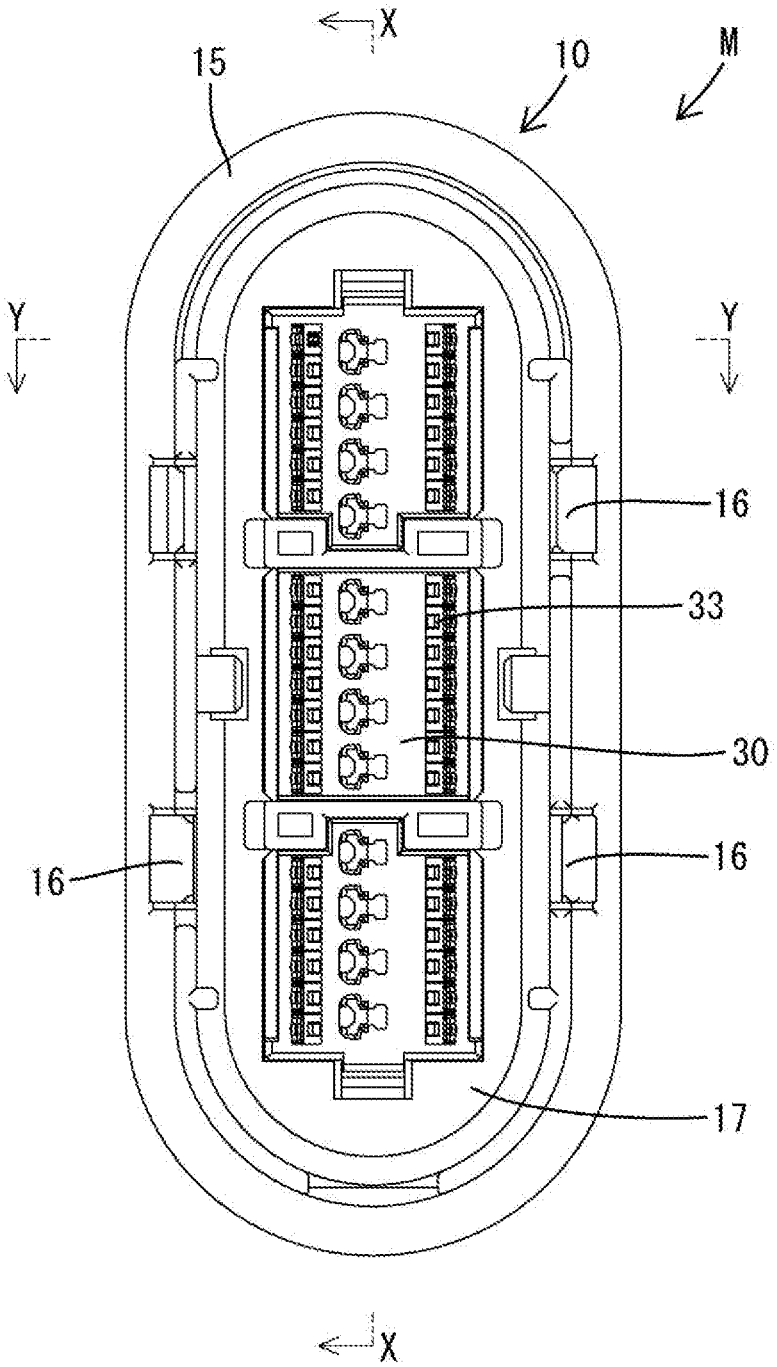
FIG. 3 is a front view of the waiting-side connector.
Figure 4:
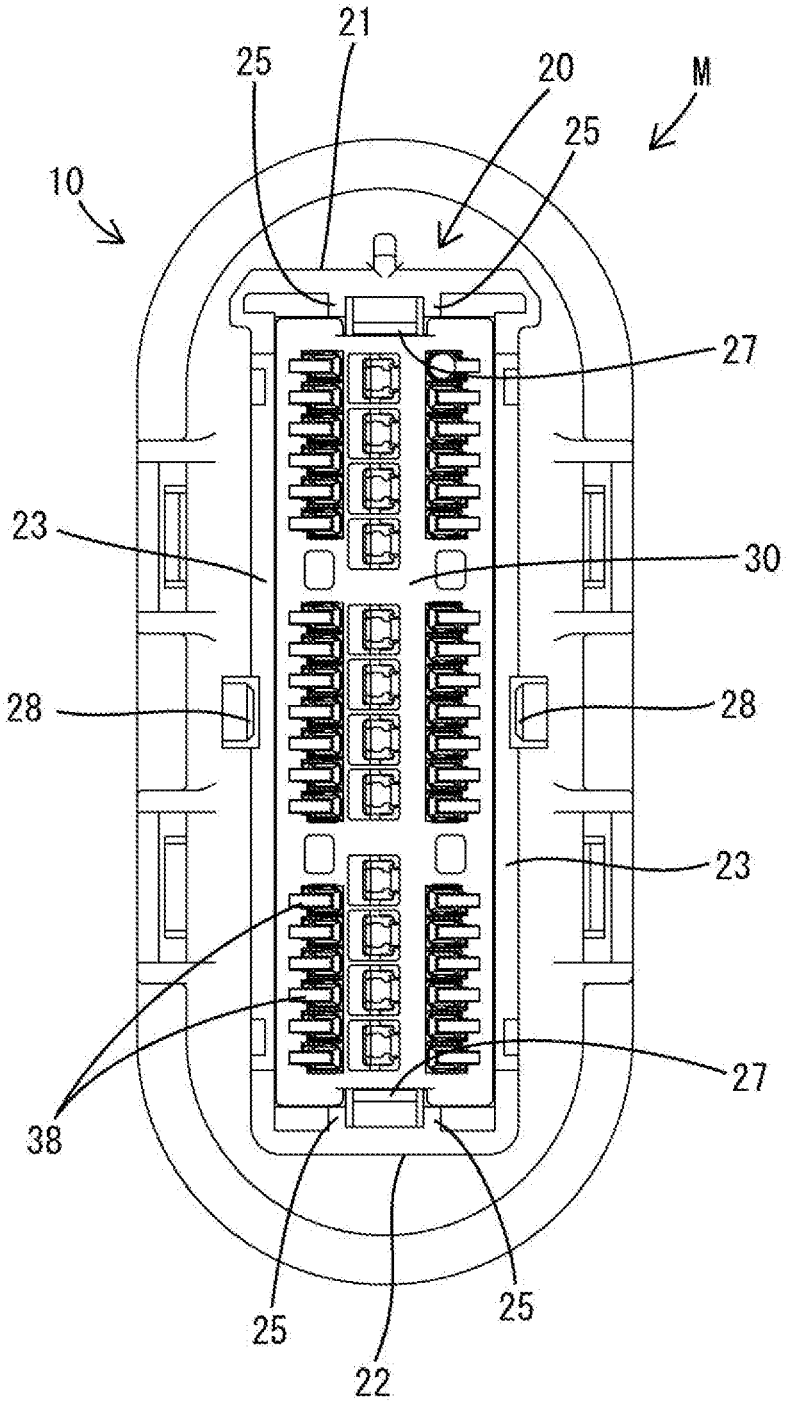
FIG. 4 is a rear view of the waiting-side connector.
Figure 5:
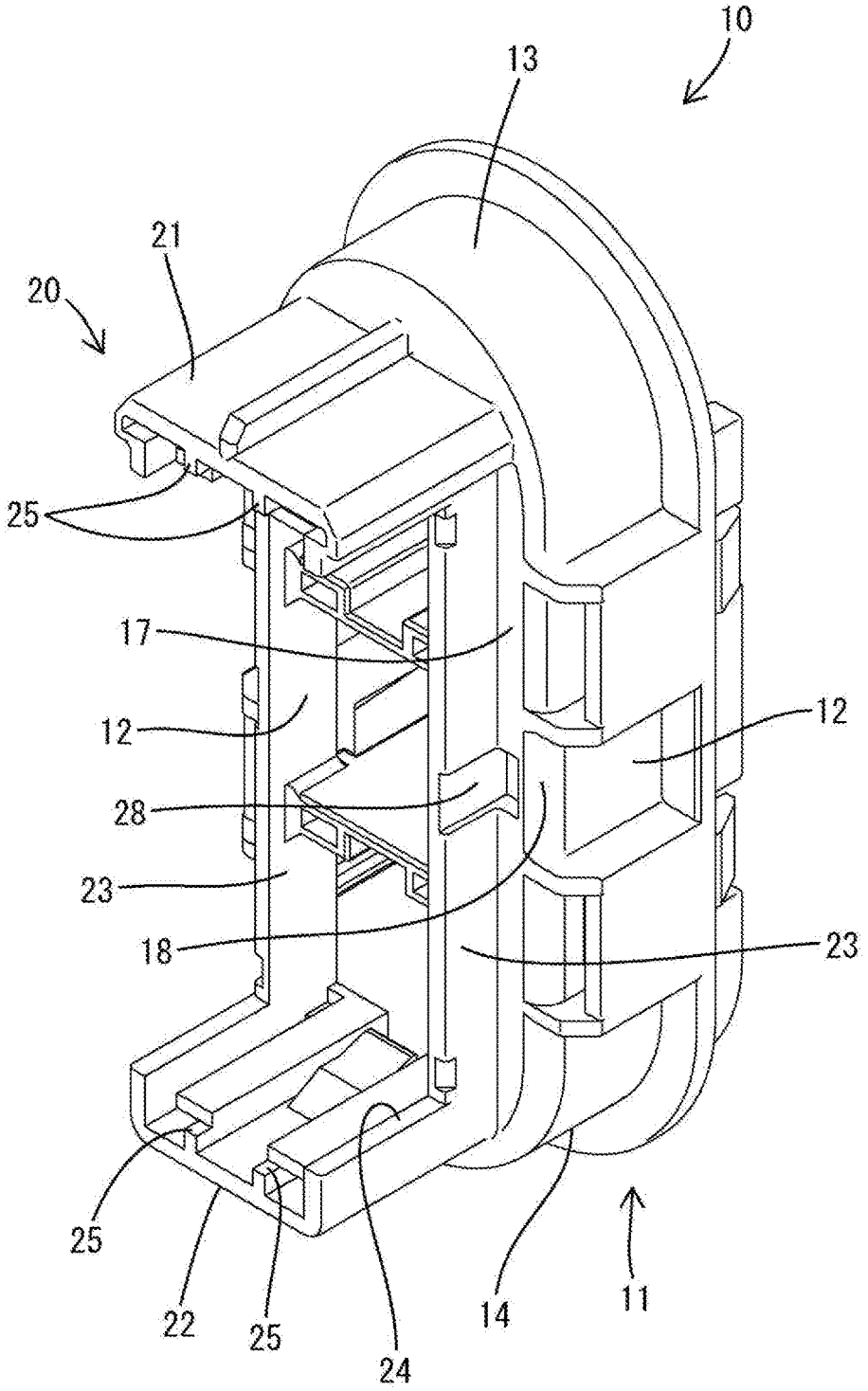
FIG. 5 is a perspective view of a frame constituting the waiting-side connector.
Figure 6:
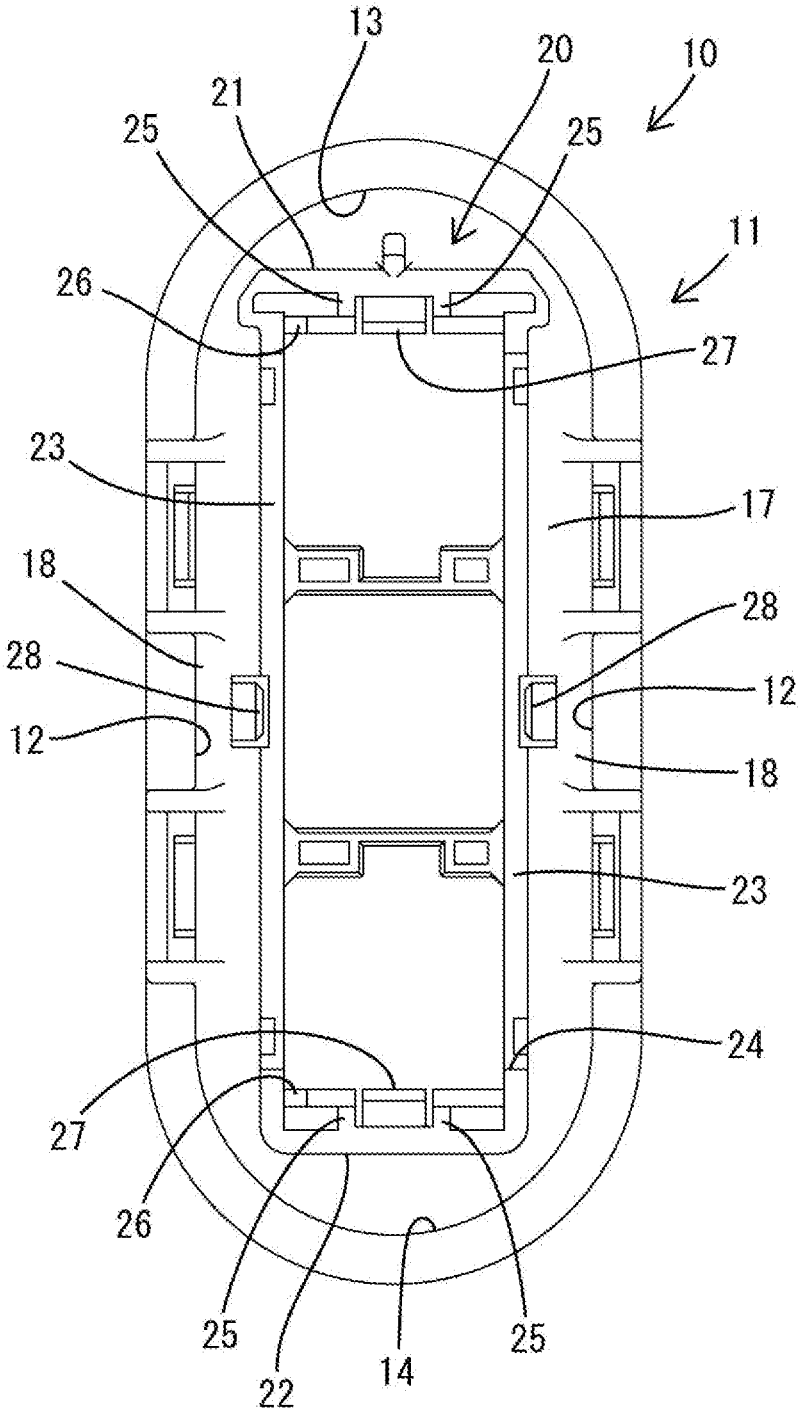
FIG. 6 is a rear view of a receptacle.
Figure 7:
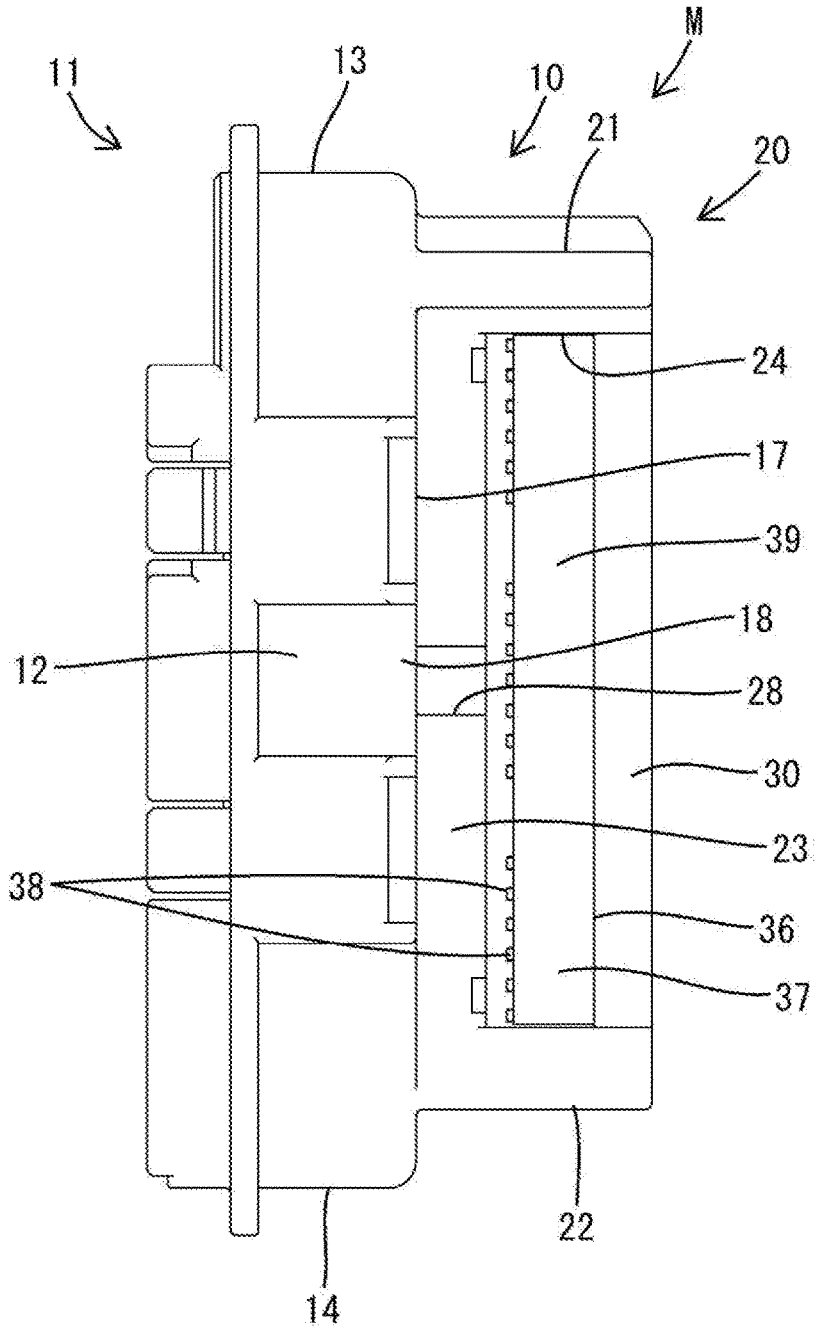
FIG. 7 is a side view showing a retainer locked temporarily in the waiting-side connector.
Figure 8:
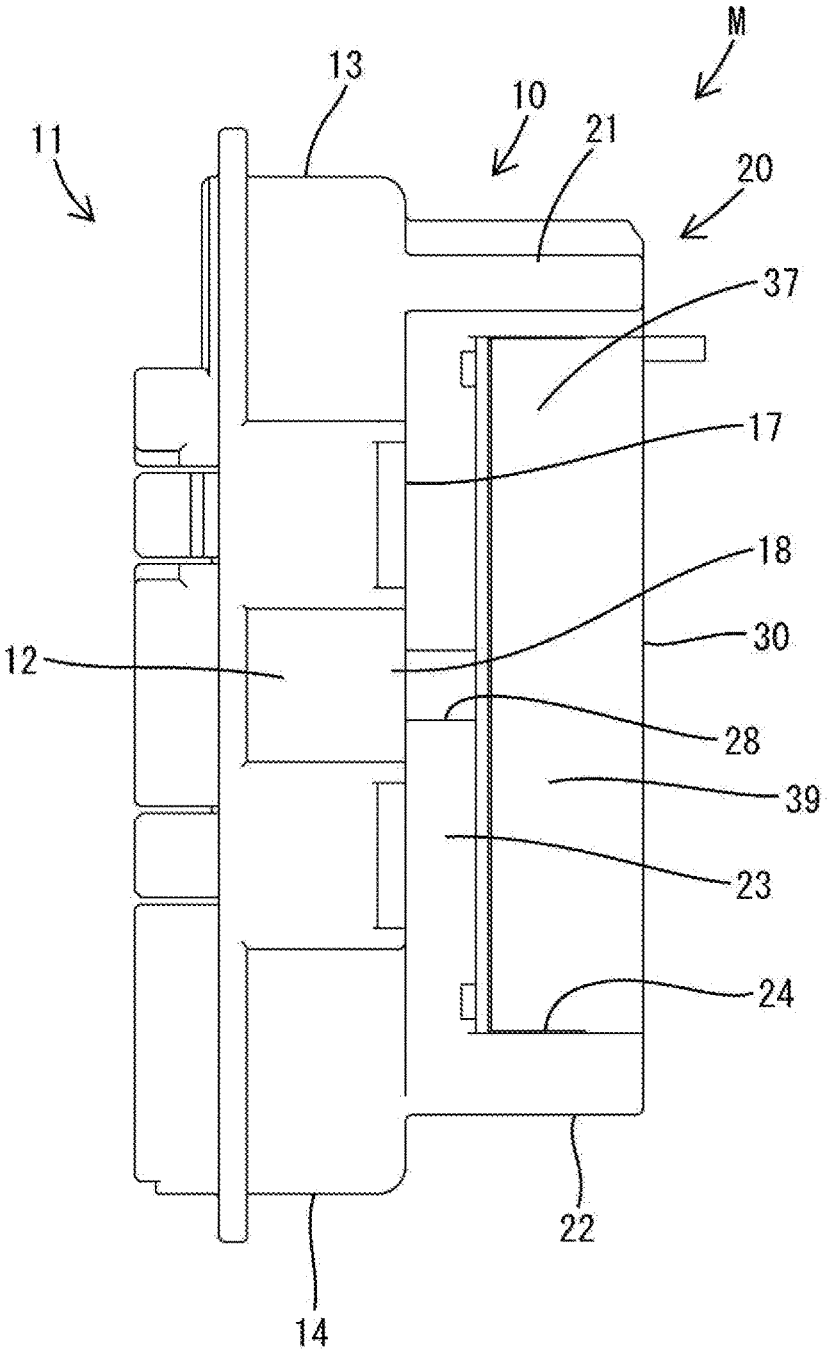
FIG. 8 is a side view showing the retainer locked completely in the waiting-side connector.
Figure 9:
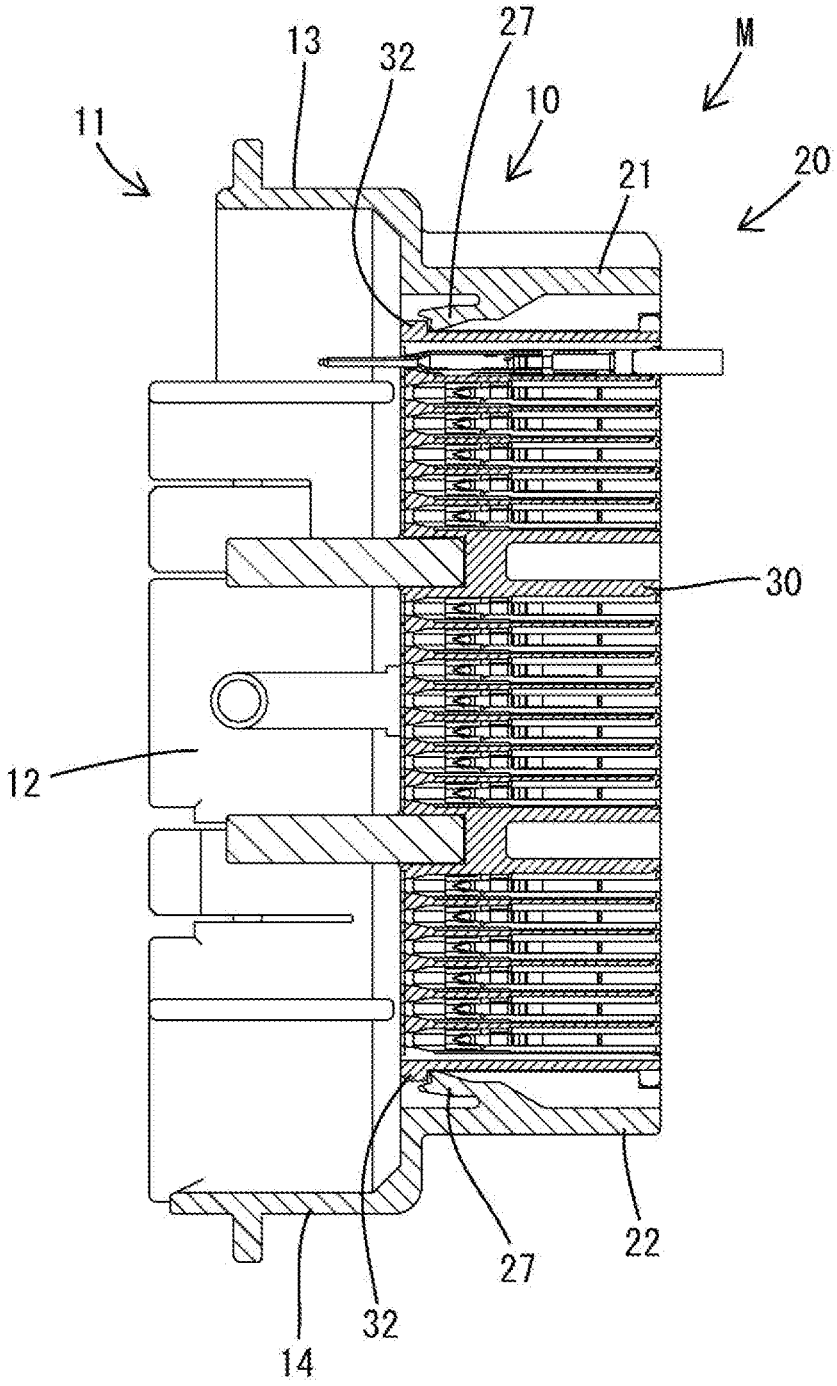
FIG. 9 is a section along X-X of FIG. 3.
Figure 10:
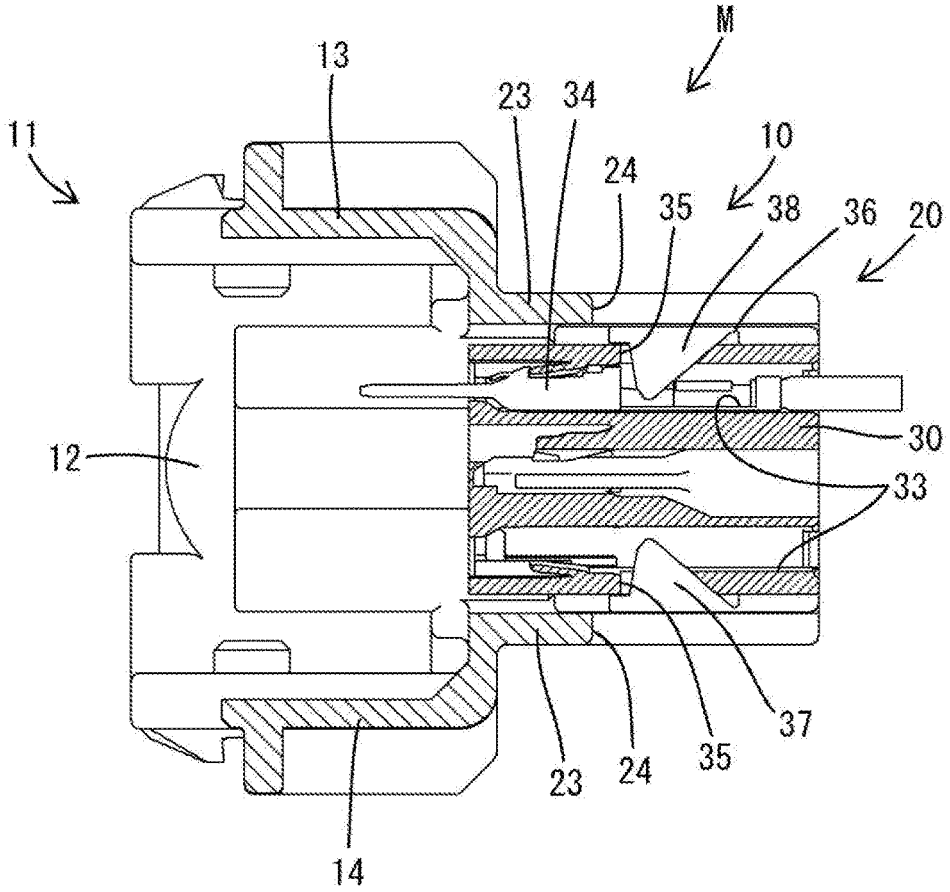
FIG. 10 is a section along Y-Y of FIG. 3.

The sub-housing 30 is a vertically long block. As shown in FIG. 1, a butting rib 31 and a retaining projection 32 are formed on each of the upper and lower surfaces of the sub-housing 30. The sub-housing 30 is mounted into the holding portion 20 from behind the frame 10. In a mounted state, the upper holding wall 21, the lower holding wall 22 and the left and right side holding walls 23 are respectively in contact with or proximately facing the upper, lower and left and right side surfaces of the sub-housing 30. In this way, movements of the sub-housing 30 relative to the frame 10 (holding portion 20) in the vertical and lateral directions are restricted. Further, in the mounted state, the butting ribs 31 are in contact with the front-stops 26 so that a forward movement of the sub-housing 30 relative to the frame 10 is restricted. Further, a backward movement of the sub-housing 30 relative to the frame 10 is restricted by the locking lances 27 being locked to the retaining projections 32.

Terminal accommodating chambers 33 are formed in the sub-housing 30. The terminal accommodating chambers 33 are arranged separately side by side on left and right sides and at predetermined intervals in the vertical direction. A male terminal fitting 34 is inserted in each terminal accommodating chamber 33. The sub-housing 30 is formed with communication holes 35 that communicate respectively with the terminal accommodating chambers 33. The communication holes 35 are open on the side surfaces of the sub-housing 30. All of the communication holes 35 are arranged within ranges of the opening areas of the openings 24 when the sub-housing 30 is mounted in the holding portion 20.

Retainers 37 are coupled via hinges 36 to rear edge parts of opening areas of the communication holes 35 on the side surfaces of the sub-housing 30. Each retainer 37 includes retaining portions 38 and a base plate 39 supporting the retaining portions 38. The retaining portions 38 fit into the respective communication holes 35 and lock the male terminal fittings 34. The rear end edge of the base plate 39 is connected to the hinge 36.

The retainer 37 is pivotally displaceable between a separated state (temporary locking position) and a locking state (complete locking position) with the hinge 36 acting as a fulcrum. The retaining portions 38 are retracted from the terminal accommodating chambers 33 when the retainer 37 is in the separated state. Thus, the male terminal fittings 34 can be inserted into and withdrawn from the terminal accommodating chambers 33. However, the retaining portions 38 are in the terminal accommodating chambers 33 when the retainer 37 is in the locking state and lock the male terminal fittings 34 inserted into the terminal accommodating chambers 33. This locking reliably retains the male terminal fittings 34.

The retainers 37 project laterally out from outer side surfaces of the sub-housing 30 when the sub-housing 30 is mounted into the holding portion 20 and the retainers 37 are displaced to the separated state. However, the retainers 37 do not interfere with the holding portion 20. Further, the outer surfaces of the base plates 39 are substantially flush with the outer side surfaces of the sub-housing 30 when the retainers 37 are displaced to the locking state.

The waiting-side connector M is assembled by assembling the sub-housing 30 with the holding portion 20 of the frame 10 in a state where the male terminal fittings 34 are not inserted. At this time, the retainers 37 are in the separated state. The vertical formation areas of the retainers 37 are within the ranges of the openings 24 of the holding portion 20 so that the retainers 37 do not interfere with the side surface holding walls 23 of the holding portion 20 when assembling the sub-housing 30. The male terminal fittings 34 are inserted into the terminal accommodating chambers 33 from behind the sub-housing 30 after the sub-housing 30 is mounted into the holding portion 20. Finally, the retainers 37 are displaced from the separated state to the locking state to retain the male terminal fittings 34, thereby completing the assembling of the waiting-side connector M.

The male terminal fittings 34 may have to be removed for maintenance from an assembling completed state. In this situation, the retainers 37 are displaced from the locking state to the separated state with the sub-housing 30 kept mounted in the frame 10 (holding portion 20). At this time, the long and narrow jig J is placed in the guide groove 28 and the tip of the jig J is slid toward the retainer 37. A vertical movement of the jig J is restricted by the guide groove 28. Then, the jig J is brought into contact with the step 18, the tip of the jig J is slipped under the front end of the retainer 37 and the retainer 37 is lifted to the separated state, utilizing the principle of leverage.

The waiting-side connector M includes the frame 10 and the sub-housing 30. The frame 10 is formed with the holding portion 20 for holding the sub-housing 30 by being locked to the outer surface of the sub-housing 30 and the male terminal fittings 34 are inserted into the sub-housing 30. The sub-housing 30 is provided with the retainers 37 exposed on the outer surface thereof. The retainers 37 are displaced between the locking state for retaining the male terminal fittings 34 inserted into the sub-housing 30 and the separated state for allowing the inserted male terminal fittings 34 to be withdrawn from the sub-housing 30.

The frame 10 is formed with the openings 24 configured to expose the retainers 37 with the sub-housing 30 held in the holding portion 20. Accordingly, the male terminal fittings 34 can be separated from the sub-housing 30 by displacing the retainers 37 from the separated state to the locking state with the sub-housing 30 mounted in the frame 10. Accordingly, the sub-housing 30 need not be separated from the frame 10 so that the number of operation steps can be reduced.

The retainers 37 are coupled to the sub-housing 30 via the hinges 36. Thus, fewer components are required as compared to the case where the retainers 37 and the sub-housing 30 are separate components. Further, when being in the separated state, the retainers 37 project from the outer surface of the sub-housing 30 and the openings 24 are open backward with respect to an assembling direction of the sub-housing 30 with the holding portion. Therefore, the sub-housing 30 can be assembled with the holding portion 20 with the retainers 37 kept in the separated state.

The holding portion 20 is cantilevered back and the upper and lower holding walls 21, 22 are formed with the reinforcing ribs 25 extending along a front-back direction. Accordingly, improper deformation of the cantilevered upper and lower holding walls 21, 22 is prevented so that the sub-housing 30 can be held reliably in the holding portion 20.

The steps 18 protrude farther out than the outer surfaces of the retainers 37 at positions on the outer surface of the frame 10 in front of and near the retainers 37. The holding portion 20 is formed with the guide grooves 28 to guide the jig J from the side of the step 18 toward the retainer 37 for displacing the retainer 37 from the locking state to the separated state. In displacing the retainer 37 to the separated state, the jig J is moved along the guide groove 28 and brought closer to the retainer 37 from the side of the step 18. An operation of moving the jig J along the guide groove 28 is difficult to perform because the step 18 protrudes farther out than the outer surface of the retainer 37. Thus, even if the retainers 37 are exposed to outside in the openings 24, there is no possibility that the retainers 37 are displaced inadvertently to the separated state.

The invention is not limited to the above described and illustrated embodiment. For example, the following embodiments are also included in the scope of the invention.

Although the retainer is coupled to the sub-housing via the hinge in the above embodiment, the retainer and the sub-housing may be separate components.

The opening is open back with respect to the assembling direction of the sub-housing with the holding portion in the above embodiment. However, the opening may be a window whose opening edge is continuous over the entire periphery without being open backward with respect to the assembling direction of the sub-housing with the holding portion.

The guide groove is configured to guide the jig from the side of the step toward the retainer in the above embodiment. However, the guide groove may be configured to guide the jig from a side opposite the step toward the retainer.

Although a connector to be mounted on the panel is described in the above embodiment, the invention can be applied to connectors not mounted on a panel.

LIST OF REFERENCE SIGNS

J . . . jig
M . . . waiting-side connector
10 . . . frame
18 . . . step
20 . . . holding portion
24 . . . opening
25 . . . reinforcing rib
28 . . . guide groove
30 . . . sub-housing
34 . . . terminal fitting
36 . . . hinge
37 . . . retainer

What is claimed is:

1. A connector, comprising:

a frame;

a sub-housing formed with an accommodating chamber;

a holding portion formed in the frame and configured to hold the sub-housing by being locked to an outer surface of the sub-housing;

a terminal fitting inserted in the accommodating chamber of the sub-housing;

a retainer exposed on the outer surface of the sub-housing, the retainer including a retaining portion that is displaceable between a locking state where the retaining portion projects into the accommodating chamber for locking the terminal fitting that has been inserted into the accommodating chamber to retain the terminal fitting in the accommodating chamber of the sub-housing and a separated state for allowing the inserted terminal fitting to be withdrawn from the accommodating chamber of the sub-housing; and an opening formed in the frame and configured to expose the retainer when the sub-housing is held in the holding portion.

2. The connector of claim 1, wherein:

the holding portion is cantilevered from the frame; and the holding portion is formed with a reinforcing rib extending along a projecting direction of the holding portion.

3. The connector of claim 1, wherein the retainer is a unitary part of the sub-housing that is coupled unitarily to the sub-housing via a hinge.

4. The connector of claim 3, wherein:

the retainer projects from the outer surface of the sub-housing in the separated state; and the opening is open backward with respect to an assembling direction of the sub-housing with the holding portion.

5. A connector, comprising:

a sub-housing;

a terminal fitting inserted in the sub-housing;

a retainer exposed on the outer surface of the sub-housing and displaceable between a locking state for retaining the terminal fitting inserted into the sub-housing and a separated state for allowing the inserted terminal fitting to be withdrawn from the sub-housing; and a frame including a holding portion configured to hold the sub-housing by being locked to an outer surface of the sub-housing, an opening formed in the frame and configured to expose the retainer with the sub-housing held in the holding portion a frame including a holding portion configured to hold the sub-housing by being locked to an outer surface of the sub-housing, an opening formed in the frame and configured to expose the retainer with the sub-housing held in the holding portion, a step formed on an outer surface of the frame and protruding farther out than an outer surface of the retainer, and a guide groove formed in the frame and configured to guide a jig from a side of the step toward the retainer for displacing the retainer from the locking state to the separated state.

* * * * *